United States Patent [19]

Eckstein et al.

[11] 4,133,252

[45] Jan. 9, 1979

[54] METHOD AND APPARATUS FOR SECURING CARRYING HANDLES TO BAGS

[75] Inventors: Ernest Eckstein, 69 Cross Hwy., West Port, Conn. 06880; Anton Helmle, Yonkers, N.Y.; Jordan Perlin, Roslyn, N.Y.; Irving Spitalnik, East Hills, N.Y.

[73] Assignee: Ernest Eckstein, West Port, Conn.

[21] Appl. No.: 685,325

[22] Filed: May 11, 1976

[51] Int. Cl.[2] ..... B31B 37/74

[52] U.S. Cl. ..... 93/35 H; 53/134; 93/8 WA; 93/22

[58] Field of Search ..... 93/8 R, 8 WA, 14, 16, 93/17, 21, 22, 24, 25, 28, 30, 35 H, 44, 53 SD; 53/134, 386

[56] References Cited

U.S. PATENT DOCUMENTS

| | | | |
|---|---|---|---|
| 3,306,802 | 2/1967 | Wilcox et al. | 53/134 X |
| 3,466,980 | 9/1969 | Achelpohl | 93/8 R |
| 3,507,194 | 4/1970 | Schwarzkopf | 93/8 R |
| 3,547,010 | 12/1970 | Gennerich | 93/22 |
| 3,618,476 | 11/1971 | Achelpohl | 93/8 R |
| 3,783,752 | 1/1974 | Langen et al. | 93/53 SD |
| 3,974,747 | 8/1976 | Tsukino | 93/8 R X |

FOREIGN PATENT DOCUMENTS

| | | | |
|---|---|---|---|
| 1913037 | 4/1972 | Fed. Rep. of Germany | 93/35 H |

*Primary Examiner*—Roy Lake
*Assistant Examiner*—Paul A. Bell
*Attorney, Agent, or Firm*—Friedman, Goodman & Teitelbaum

[57] ABSTRACT

An apparatus for securing handles onto a stream of bags sequentially transported on a first conveyer and then is engaged by a second conveyer. The second conveyer interacts with the first conveyer to receive the bags and take them through a series of stations. At one of these stations, handles are attached to each of the bags. A supply of handle material is cut into flat strips. The flat strips are bent into a U-shape and the legs thereof are fastened onto the bags.

21 Claims, 5 Drawing Figures

METHOD AND APPARATUS FOR SECURING CARRYING HANDLES TO BAGS

BACKGROUND OF THE INVENTION

This invention relates to carrying bags and more particularly to a method and apparatus for applying and securing handles onto the carrying bags.

Carrying bags having U-shaped carrying handles are well known in the art. There are numerous types of processes and apparatus for forming the bags and for applying handles to the bags. Some of these apply the handles to either the outside or the inside of the mouth of the bag by welding or heat sealing operations. In most cases, two carrying handles are applied respectively to each of the two walls of the bag. In applying both handles, the process becomes quite complex. By using heat responsive materials in a heat sealing operation there occurs the problem of restricting the heat to only effect certain of the layers therebeneath. For example, in fastening two handles respectively to the two outer surfaces of the bags, a mandrel is generally inserted between the two inner surfaces of the bags to prevent the heat from sealing together the walls of the bag, as disclosed in U.S. Pat. No. 3,507,194, granted Apr. 21, 1970 to August Schwarzkopf. When applying the handles to the inner surfaces of the bag, it is necessary to utilize a non-weldable layer adhering to the inner side surfaces of the carrying handle strips as they are inserted inside the mouth of the bag.

Further complexities have arisen with prior art apparatus since they have generally attempted to apply the handles simultaneously with the formation of the bag itself. Such apparatus typically utilize a rolling process for forming the bags, and prior to the separation of the individual bag from the length of the bag tubing, the handles are applied. This complicates matters since it is therefore necessary to have expensive mechanism and apparatus to form slits or spaces which separates the walls of the bags to insert the handles.

Additionally, the prior art apparatus have generally been limited to utilizing only certain types of materials for the bags and handles. Most frequently, plastic bags and plastic handles are utilized. However, it is often required to form paper bags and apply either plastic or cardboard handles to the paper bags. Existing apparatus are generally designed for only one type of material and it is not possible to easily change the machinery to accommodate either plastic or paper bags.

SUMMARY OF THE INVENTION

It is accordingly an object of the present invention to provide an apparatus for securing handles onto bags which avoids the aforementioned problems of prior art apparatus.

A further object of the present invention is to provide an apparatus which secures handles onto a stream of bags in a simplified, easily controlled and inexpensive operation.

Still another object of the present invention is to provide an apparatus which receives a bag, opens the mouth of the bag, and attaches handles onto the inside of the mouth of the bag.

A further object of the present invention is to provide an apparatus for securing handles onto a bag which includes two conveyers which interact in synchronous operation, one of the conveyors applying a sequential stream of bags and the other conveyer containing operating heads which engage the stream of bags and operate on them through a series of stations.

Yet a further object of the present invention is to provide an apparatus for securing handles onto bags and which can utilize either plastic or cardboard handles and can act upon either plastic or paper bags, interchangeably.

Still a further object of the present invention is to provide an apparatus for securing handles onto a bag which attaches the handles by forming flat strips of handle material into a U-shape, and fastens leg portions of the U-shape handle strips to the mouth of the bag.

Yet a further object of the present invention is to provide a method for securing handles onto bags which is simple to execute, inexpensive to operate, and effective in its procedure.

Still another object of the present invention is to provide a method and apparatus for securing handles onto bags, utilizing mass production techniques in a simplified operation.

These objects are achieved in accordance with a preferred embodiment of the present invention wherein the apparatus for securing handles onto bags comprises a first conveyer means for sequentially transporting a stream of bags. A second conveyer means engages the bags and operates thereon through a series of stations. At one of the stations, there is included means for attaching handles to the bags.

In an embodiment of the invention, the second conveyer means comprises a plurality of operating heads arranged to sequentially move through the series of operating stations. Each of the operating heads includes support plates which grasp the bags at a first station and releases the bags at a subsequent station downstream of the first station.

The operating heads are carried on an endless belt and each support plate includes a vacuum plate pivotally mounted onto a bracket. A spider mechanism, rotating with the endless belt, connects an air cylinder to each vacuum plate for moving it to an open and closed position, and also connects a vacuum air hose to each vacuum plate. At the first station, the air cylinder closes opposing vacuum plates onto the mouth of the bag. A vacuum is formed at the vacuum plates to grasp the bag walls. At a subsequent station, the air cylinders open the vacuum plates forming a flat planar surface. At a third station, the handles are attached by a head sealing operating against the planar vacuum plates. The vacuum is then released permitting the first conveyer means to continue transporting the stream of bags and carry them away from the second conveyer means.

In an embodiment of the invention, the means for attaching handles includes means for forming flat strips of material into a U-shape so as to provide a carrying handle having a central portion and a pair of leg portions. Means are also included for fastening the legs portions to the bags.

The first and second conveyer means operate in synchronism to transport the stream of bags through the series of stations, so that while the operating heads of the second conveyer means grasp and act upon the bags, the first conveyer means continues to transport the stream of bags through the series of stations.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENT

Figure 1:
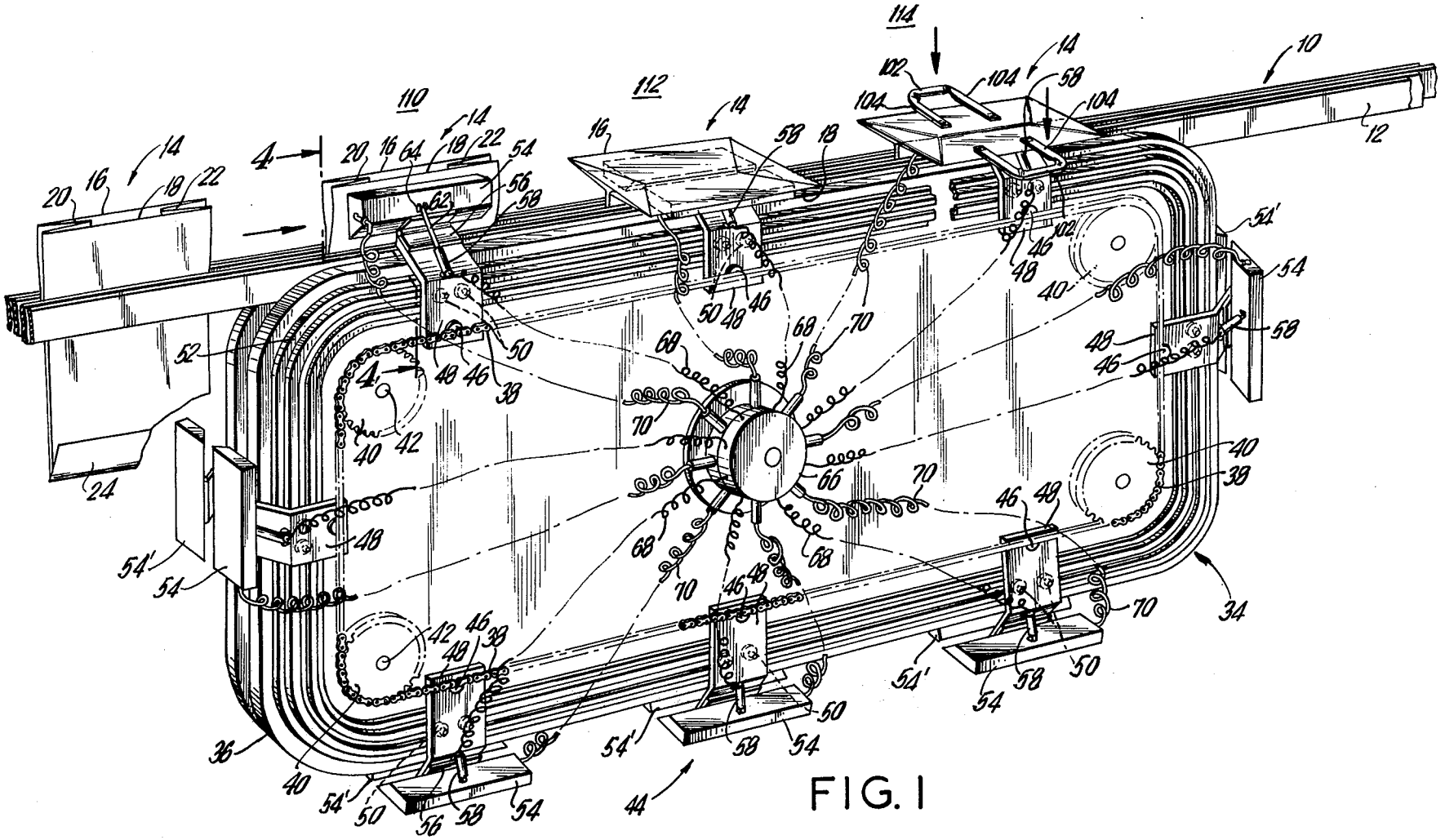
FIG. 1 is a perspective view illustrating one embodiment of the apparatus for securing handles onto bags, in accordance with the present invention.
Figure 4:
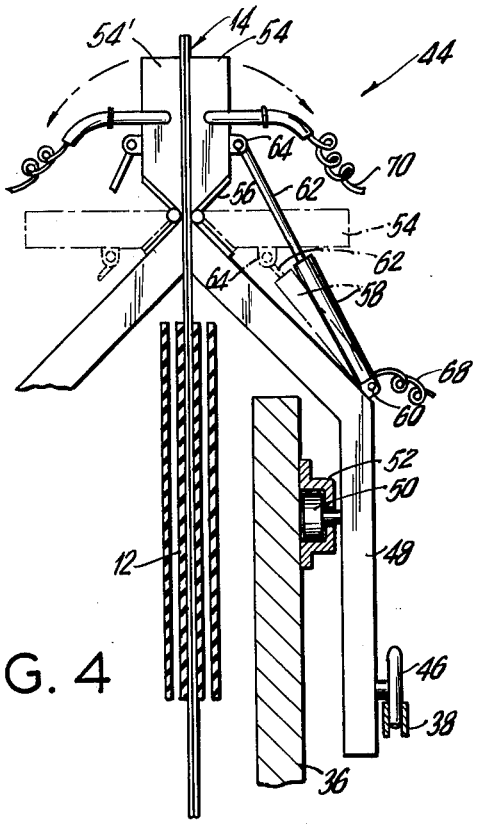
FIG. 4 is a fragmentary, transverse, sectional view taken along line 4—4 of FIG. 1.
Figure 5:
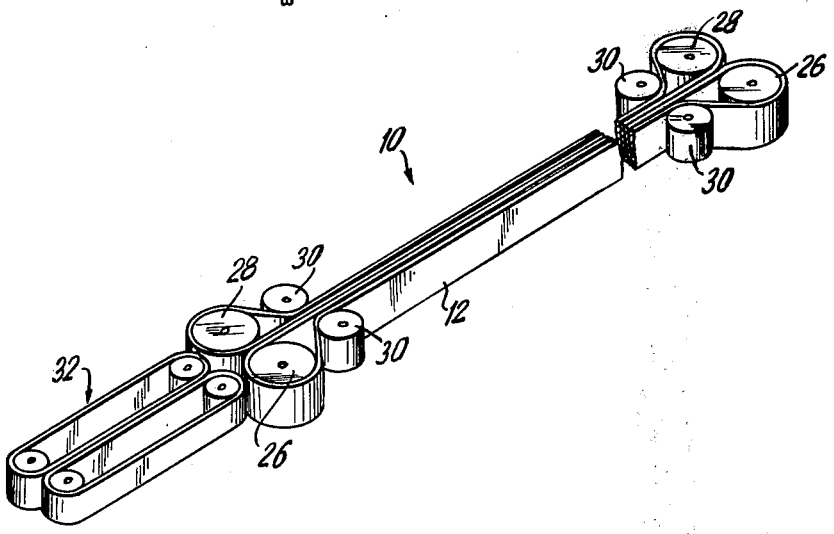
FIG. 5 is a perspective view of the first conveyer means which sequentially transports the stream of bags.

Referring now to FIGS. 1, 4 and 5, there is shown the apparatus for securing handles onto bags including a first conveyer system 10 including a series of belts 12 which carry a stream of bags 14. The bags are show including first and second walls 16, 18 with gussets 20 and 22 respectively formed on either side. An upwardly folded bottom section 24 is also shown, although other types of bags could be utilized, including a V-shaped bag as well as bags having a gusset on the bottom. The first conveyer 10 is driven by the drive rollers 26, 28 at either end of the belt and includes a number of pinch rollers 30 for controlling the spacing and tightness of the belts. A number of transfer belts 32 are shown which transfers the bags from other apparatus (not shown) such as a bag forming apparatus. A second conveyer means 34 includes a frame 36 of substantially rectangular configuration and having rounded edges. Positioned on both surfaces of the frame is an endless belt, shown by way of example as the chain belt 38 passing around the pulleys 40 which are pinned to the frame at 42.

Attached to the chain belt 38 are eight operating heads 44 which are secured to the chain belt by means of a flange or guide wheel 46. The operating heads each include a bracket 48 on either side of the frame 36 which is driven by the chain belt and can move with respect to the frame 36 by means of a roller 50 which passes through a guideway 52 on the frame 36 which serves as a track for the operating heads.

Pivotally connected to each bracket is a support plate 54 which is held by means of the hinge 56. An air cylinder 58 is connected at one end by means of the lug 60 to the bracket 48 and has its piston 62 connected by means of the lug 64 to the support plate 54. When extended, piston rod 62 holds the support plate 54 in a closed position wherein it is adjacent its opposing support plate 54' and grasps a bag 14 therebetween. In its open position, as shown in phantom, the support plates 54 and 54' lie in a substantially planar position forming a flat surface.

A spider mechanism 66 is positioned on the frame 36 and is free to rotate along with the endless belt 38. Extending from the spider mechanism to each operating head are a pair of conduits including a first conduit 68 serving as an air hose and controling the operation of the cylinder 58 and a second conduit 70 serving as a vacuum hose and forming a vacuum at the surface of the support plates 54.

Figure 2:
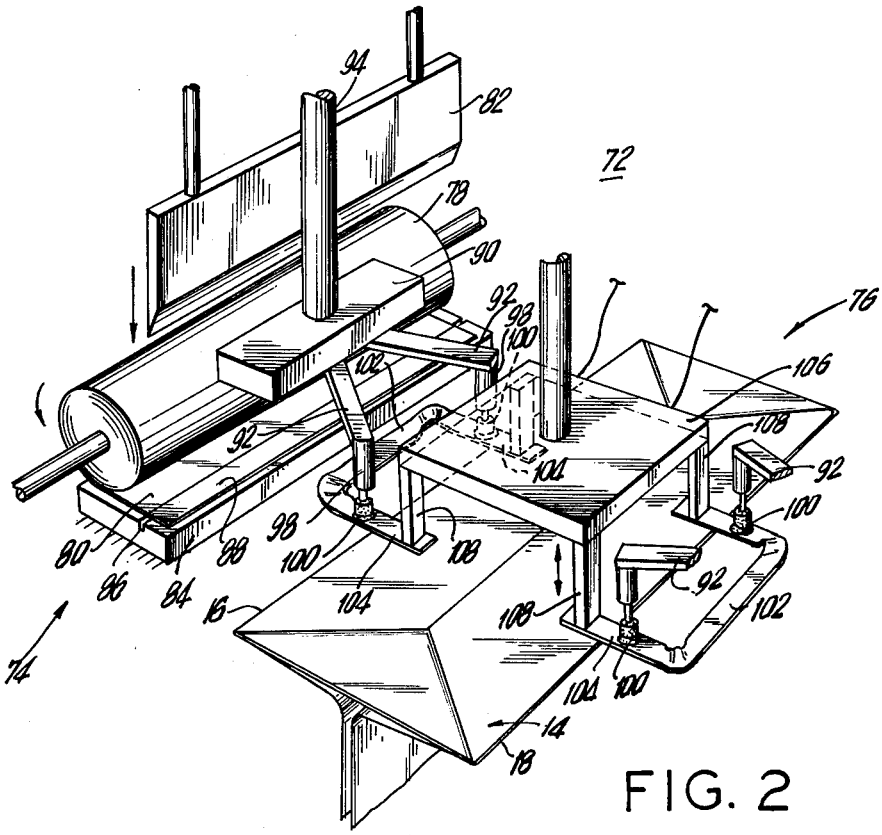
FIG. 2 is a perspective view illustrating an embodiment of the apparatus which forms and attaches handles to the bags at one of the stations.
Figure 3:
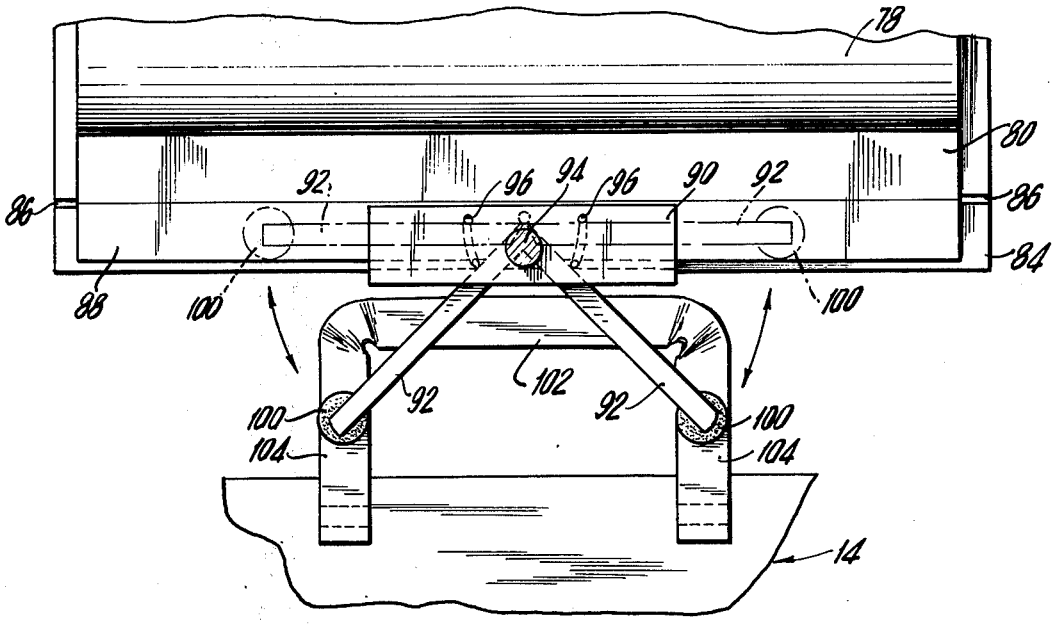
FIG. 3 is a top view of parts of the apparatus for attaching handles, and specifically shows the formation of the U-shaped handles.

Referring now to FIGS. 2 and 3, there will be described the apparatus utilized for attaching handles to the bags. The apparatus is shown generally at 72 and includes a first mechanism 74 which forms flat strips of material into a U-shape, and a second mechanism 76 which fastens the leg portions of the U-shaped handles to the bag. The first mechanism 74 includes a supply roll 78 which supplies a continuous feed of handle material 80. A blade 82 is positioned over a platen 84 and cooperates with a groove 86 formed in the platen to cut a flat strip of material 88 from the supply roll when the blade is lowered. A grasping head 90 is positioned over the platen 84 and includes grasping arms 92 which are rotatably mounted about their connecting post 94 which serves as an axes of rotation. The grasping post 90 includes cutouts 96 which receives pins (not shown) on the undersurface of the grasping arms 92 and permit arcuate movement of the arms 92. At the end of each grasping arm 92 is a pickup leg 98 including a lower foot 100 which grasps the flat strip near the ends thereof. As the grasping arms 92 rotate, the feet 100 push the end portions of the flat handle strip together, pivotally moving them towards each other while the central portion is kept relaxed. As a result of the arcuate movement of the legs 92, the flat strip 88 is formed into a U-shape handle having legs 104 and a central portion 102.

The feet 100 can include suction means which grasp the flat strip and retain it while being formed into the U-shape. Alternately, they could include needles which forms small pinholes near the ends of the flat strip 88 and by means of needles the strip is held while being bent into its U-shape.

The feet 100 continue to hold the legs of the handle while a heat sealing head 106 containing four legs 108 is lowered over the legs 104. Heat is then applied to thermally connect the handle onto the mouth of the bag 14. The support plates serve as the planar surface against which the heat sealing apparatus is lowered during the welding operation. Though heat sealing is preferred, other suitable joining or sealing means may be used, which are well known in the art.

Referring now to FIG. 1, the operation of the apparatus will now be described. A stream of bags is continuously supplied by the conveyer belt 12. Simultaneously, the chain belt 38 drives the operating heads 44 around the frame of the second conveyer means 34. The conveyer belt and the chain belt are synchronized so that at the arrival of a bag to a first section, indicated at 110, an operating head will be positioned in place. The spider mechanism is controlled in a conventional manner to supply air to the cylinder of the operating head thereby closing the support plates against the bag walls. The vacuum system is also operated in a conventional manner to introduce a vacuum at the surface of the support plates permitting the support plate to grasp the bag walls at the first station. The chain belt and the conveyer belt operate in synchronism to transport the bag to the second position 112. At this position, the spider mechanism is controlled to cause the air cylinder to retract its piston thereby opening the support plates for forming a flat planar surface of the two support plates and thereby opening the mouth of the bag. The gussets in the bag will permit the bag mouth to spread apart with the gussets lying flat against the support plates. The conveyer belt and chain belt continue to operate in synchronism to transport the now open bag to the third position 114 where the heat sealing apparatus shown in FIG. 2 is located and where the U-shaped handles are attached to either side of the inner surface of the mouth of the bag. The spider mechanism is then controlled to release the vacuum at the surface of the support plates thereby releasing the bag. The support plates continue to remain open and as both the conveyer belt 12 and chain belt 38 continue to operate, the bag will be withdrawn from the second conveyer means 34 and permitted to continue its movement along the conveyer belt alone. The operating heads continue around the frame on the chain belt with the support plates open until they next reach the first position 110 where the process is repeated.

The process is a continuous one so that each successive operating head grasps the next sequential bag in the stream of bags and acts upon it to apply handles thereto. While only one stream of bags is shown, it is understood that a second stream could also be supplied in the opposite direction at the lower portion of the chain belt and the spider mechanism could be controlled to simultaneously cause the three upper operating heads and the three lower operating heads to work simultaneously thereby providing two streams of bags with handles on them.

The apparatus heretofore described can be used in conjunction with either plastic bags or paper bags. Furthermore, the handles can either be plastic or paper, such as cardboard. With plastic material, the heat sealing operation can be applied directly to the plastic to weld the material together. With paper, a thermosensitive glue can be placed on the mouth of the bag or at the ends of the handles, where the heat sealing can also be used.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Apparatus for securing handles onto bags which are open at their top portions and closed at their sides and bottoms, said apparatus comprising:

a. first means for sequentially transporting a stream of bags;

b. second means for engaging the bags and operating thereon through a series of operations;

c. third means for attaching handles to the bags during one of said operations;

d. said second means including at least one pair of cooperating heads arranged to be moved during said series of operations;

e. each head of said pair including suction means moving therewith for grasping a portion of a bag at a first operation and releasing the portion of the bag at a subsequent operation, each of said suction means of said pair of heads including a vacuum plate to provide a pair of vacuum plates coacting together for grasping and releasing opposing outer bag walls at the top portion thereof;

f. said pair of heads further including control means for controlling the movement of said vacuum plates between a closed and an open position in order to open the top portion of the bag and fold back the top portion to a common plane to expose opposite inner wall surfaces thereof at an operation intermediate said first and said subsequent operations, said pair of vacuum plates opposing each other when in said closed position and lying adjacent each other in said common plane when in said open position; and g. said third means for attaching handles including fastening means for securing the handles directly to an inside mouth of the bag on said opposite inner wall surfaces thereof as the top portion of the bag rests against said vacuum plates in said open position, said vacuum plates acting as support means for supporting said fastening means when the handles are being secured to the bag.

2. An apparatus as in claim 1, wherein said second means includes a plurality of said pair of heads arranged to be moved through a series of operating stations.

3. An apparatus as in claim 2, and wherein said second means further comprises an endless belt supporting said heads in spaced apart relationship.

4. An apparatus as in claim 3, wherein each of said heads include a pair of opposing brackets connected to said endless belt, each bracket pivotally supporting a vacuum plate.

5. An apparatus as in claim 4, and wherein said control means is an air cylinder.

6. An apparatus as in claim 5, and further comprising a spider mechanism coupled to rotate in conjunction with said endless belt, an air hose connected from said spider mechanism to the air cylinder of each vacuum plate, and a vacuum hose connected from said spider mechanism to each vacuum plate.

7. An apparatus as in claim 6, and wherein said spider mechanism operates said air cylinders at a first station to close the vacuum plates, and operates said air cylinders at an intermediate station to open the vacuum plates.

8. An apparatus as in claim 7, and wherein said spider mechanism introduces a vacuum to the vacuum plates at said first station and releases the vacuum at a subsequent station.

9. An apparatus as in claim 2, and wherein said second means further comprises a substantially rectangular frame including a guideway located adjacent the perimeter of the frame, and wherein each of said operating heads includes rolling means positioned in said guideway for permitting movement of said operating heads around said frame.

10. An apparatus as in claim 1, and wherein both said first and said second means operate in synchronism to transport said stream of bags through said series of stations.

11. An apparatus as in claim 1, and wherein said third means for attaching handles to the bags includes means for forming flat strips of material into a U-shape so as to provide a carrying handle having a central portion and a pair of leg portions.

12. An apparatus as in claim 11, and wherein said means for forming includes grasping means cooperating with a backing means to engage end portions of said flat strip therebetween, said grasping means being rotatably mounted about their axes and adapted to move toward each other for pushing said end portions together and pivotally moving them toward each other while said central portion of the strip is kept relaxed.

13. An apparatus as in claim 12, and wherein said means for forming further comprises feeding means for continuously feeding a supply of handle material, and severing means cooperating with said backing means for cutting said supply into strips.

14. An apparatus as in claim 12, and wherein said grasping means further comprises a grasping head supporting two rotatably mounted grasping legs, each grasping leg including pickup means at an end thereof.

15. An apparatus as in claim 14, and wherein said pickup means includes suction head means.

16. An apparatus as in claim 14, and wherein said pickup means includes pinhole forming means for forming holes in the end portions of said flat strip.

17. An apparatus as in claim 1, and wherein said fastening means includes means for producing a heat sealing of the leg portions to the bag.

18. An apparatus in accordance with claim 1, wherein both the bag and handles are formed of a plastic material, and said fastening means is a sealing means.

19. A method for securing handles to bags which are open at their top portions and closed at their sides and bottoms, said method comprising the steps of:

a. sequentially transporting a stream of bags along at least one conveyer;

b. interacting said one conveyer with operating means which engages and operates on the bags by at least one station, said operating means including the steps of:

(1) engaging a top portion of a bag at said one station by means of cooperating opposing support plates;

(2) applying a suction to facing surfaces of said support plates for grasping opposing outer bag walls at the top portion thereof;

(3) opening the top portion of the bag to form an open mouth in the bag;

(4) folding back the top portion of the bag to a common plane to expose opposing inner wall surfaces of the bag when the support plates are lying adjacent each other in said common plane defining an open position; and (5) releasing the bag after the handles have been attached; and c. attaching handles to the bag by securing means after the top portion has been folded back and before the bag is released by said operating means, the step of attaching handles including fastening the handles directly to an interior of said mouth of the bag on said opposing inner wall surfaces of the bag as the top portion of the bag rests against the support plates which act to support the securing means when the handles are being fastened to the bag.

20. A method as in claim 19, and further comprising the step of transporting the bags through a series of stations by synchronous conveyance of first and second conveyers.

21. A method as in claim 19, and wherein said step of attaching further comprises the steps of:

a. forming a flat strip of material into a U-shape so as to provide a central portion and leg portions for each handle, and b. fastening said leg portions to the bag.

* * * * *